US005094184A

United States Patent [19]

Yamamoto et al.

[11] Patent Number: 5,094,184

[45] Date of Patent: Mar. 10, 1992

[54] CAPSULE SEALING APPARATUS

[75] Inventors: Taizo Yamamoto, Osaka; Tomokazu Ishimoto, Sakurai; Yoshihisa Kawaguchi, Kashihara; Takashi Tanigaki, Ikoma, all of Japan

[73] Assignee: Nippon Elanco Kabushiki Kaisha, Osaka, Japan

[21] Appl. No.: 537,500

[22] Filed: Jun. 12, 1990

[30] Foreign Application Priority Data

Jun. 12, 1989 [JP] Japan ..... 1-148651

[51] Int. Cl.[5] ..... B05C 1/02

[52] U.S. Cl. ..... 118/233; 53/376.2; 53/900; 118/258

[58] Field of Search ..... 118/209, 213, 218, 223, 118/232, 233, 239, 244, 245, 258; 156/556, 566; 53/900, 137.2, 140, 587, 376.2

[56] References Cited

U.S. PATENT DOCUMENTS 2,962,851 12/1960 Hall ..... 118/233
3,538,677 11/1970 Amoroso et al. ..... 53/900
4,866,906 9/1989 Tayebi ..... 53/900

FOREIGN PATENT DOCUMENTS 0154966 9/1985 European Pat. Off. .
0271627 6/1988 European Pat. Off. .
2139409 1/1973 France .
60-190964 9/1985 Japan .
61-68050 4/1986 Japan .
1389342 4/1975 United Kingdom .
2053927 2/1981 United Kingdom .

*Primary Examiner*—Willard E. Hoag
*Attorney, Agent, or Firm*—Morrison & Foerster

[57] ABSTRACT

A capsule sealing apparatus which includes a capsule conveyor device with horizontally maintained slats on which capsules are mounted horizontally throughout the travel, during which the seams between the caps and bodies of the capsules are sealed by rotary coating discs that pick up the sealer from a tank disposed below the capsule conveyor device.

10 Claims, 9 Drawing Sheets

CAPSULE SEALING APPARATUS

BACKGROUND OF THE INVENTION

1. Field of the Invention

The present invention relates to a capsule sealing apparatus, and more particularly to an apparatus for sealing the seams between the caps and the bodies of capsules containing powdery, granular, or liquid pharmaceutics and foodstuff.

2. Description of the Prior Art

It is known in the art to charge powdery, granular, or liquid pharmaceutics in capsules made of hard gelatin so that patients can swallow with ease. The capsules of hard gelatin have a hollow cylindrical body and a hollow cylindrical cap having a larger diameter than the body. The body is fitted in the cap after contents are charged in the body.

Depending upon the nature of the content, it is necessary to close the body with the cap liquid-tightly. If the joint between the cap and the body becomes loose after the content is charged, the content is likely to leak, and/or dirt and germs are likely to enter the capsules. This causes fatal unsanitary problems.

The inventors have made an invention relating to an apparatus for automatically sealing charged capsules, which is disclosed in Japanese Laid-Open Patent Publication (Kokai) No. 60-190964. This prior capsule sealing apparatus includes a plurality of plate-like slats on which capsules are individually mounted. Each capsule is made of a cap and a body, and during travel of the conveyor device the seam between the cap and body is sealed with a sealing medium (hereinafter referred to as "sealer") that is picked up and coated by a coating disc. The conveyor is rotated by means of endless chains or the like whereby the circulating route of the slats includes horizontally moving areas where capsules are horizontally maintained, and vertically moving areas where they take a vertical position. In the vertically moving areas a suitable means is required for preventing the capsules from falling off the slats. Such preventing means need direct contact with the capsules. If the sealer on the capsules is not dried, the sealing coat is likely to be broken. In addition, the prior art sealing apparatus uses a separate drying device. Thus, as a whole the sealing unit becomes large in size, occupying a large installation site, and the structure becomes complicated. Because of the limited space, the prior art sealing apparatus is not allowed to employ more than one coating stations. In fact, however, the single coating station is not sufficient to obtain a strong seal between the caps and the bodies of capsules.

The inventors have made another proposal which is disclosed in Japanese Laid-Open Patent Publication (Kokai) No. 61-68050. This prior art invention provides a capsule conveyor device on which capsules are at a slant in the direction in which they are conveyed, thereby ensuring that capsules of various sizes can be sealed. However, this prior invention has not solved how to coat a sealer adequately along the seams between the caps and bodies of capsules during travel.

SUMMARY OF THE INVENTION

The capsule sealing apparatus of this invention, which overcomes the above-discussed and numerous other disadvantages and deficiencies of the prior art, comprises a capsule conveyor device comprising horizontally maintained slats including capsule resting slits, each slit including an opening at its bottom, a tank for storing a sealer disposed below a circulating route of the capsule conveyor device, a rotary coating means for picking up the sealer from the tank and coating same along the seam between a cap and a body of each capsule, said rotary coating means being insertable through the openings of the capsule resting slits and coming into contact with the seams of the capsules so as to impart frictional rotating drive to the capsules.

In a preferred embodiment, the capsule resting slits slant to the extent that the capsules are accommodated therein at a slant of about 5° with respect to the horizontal plane in the direction in which the slats are circulated.

In another preferred embodiment, the capsule resting slits have side walls slanting so that the capsules accommodated therein slant in the direction in which the slats are circulated.

In a further preferred embodiment, the capsule resting slits have V-shaped side walls so that the capsules accommodated therein are kept in linear contact therewith.

In a still further preferred embodiment, the capsule resting slits slant so that the capsules accommodated therein slant with their one end downward.

In another preferred embodiment, the capsule conveyor device comprises means for shifting the capsules accommodated in the respective capsule resting slits in a desired direction by direct engagement therewith.

In a further preferred embodiment, the capsule conveyor device comprises means for positioning the capsule in place in the capsule resting slits by direct engagement therewith after they are shifted by the shifting means.

In a still further preferred embodiment, the sealing device is disposed downstream of the rotation of the slats, and comprises a second rotary coating means for coating the sealer picked up from the tank on the seams coated by the first coating means, the second coating means being adapted to be inserted through the openings of the capsule resting slits and come into contact with the seams of the capsules so as to cause same to rotate.

In a preferred embodiment, the coating means comprises a V-shaped peripheral edge along its entire circumference and the second coating means comprises a stepped peripheral edge along its entire circumference so that the peripheral edges come into full contact with the seams between the caps and the bodies of capsules.

In another preferred embodiment, the capsule conveyor device is covered by a drying duct, except for a portion thereof at which the sealing means is located.

Thus, the invention described herein makes possible the objectives of (1) providing a capsule sealing apparatus having a simplified construction and capable of readily assembling, maintaining and repairing, (2) providing a capsule sealing apparatus capable of drying the sealer coated on the capsules during travel in a relatively short period of time, (3) providing a capsule sealing apparatus capable of sealing the capsules irrespective of variations in sizes, and (4) providing a capsule sealing apparatus capable of effecting double coats on the seams between the caps and the bodies of capsules so as to secure sufficient thickness of coat throughout the seams.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
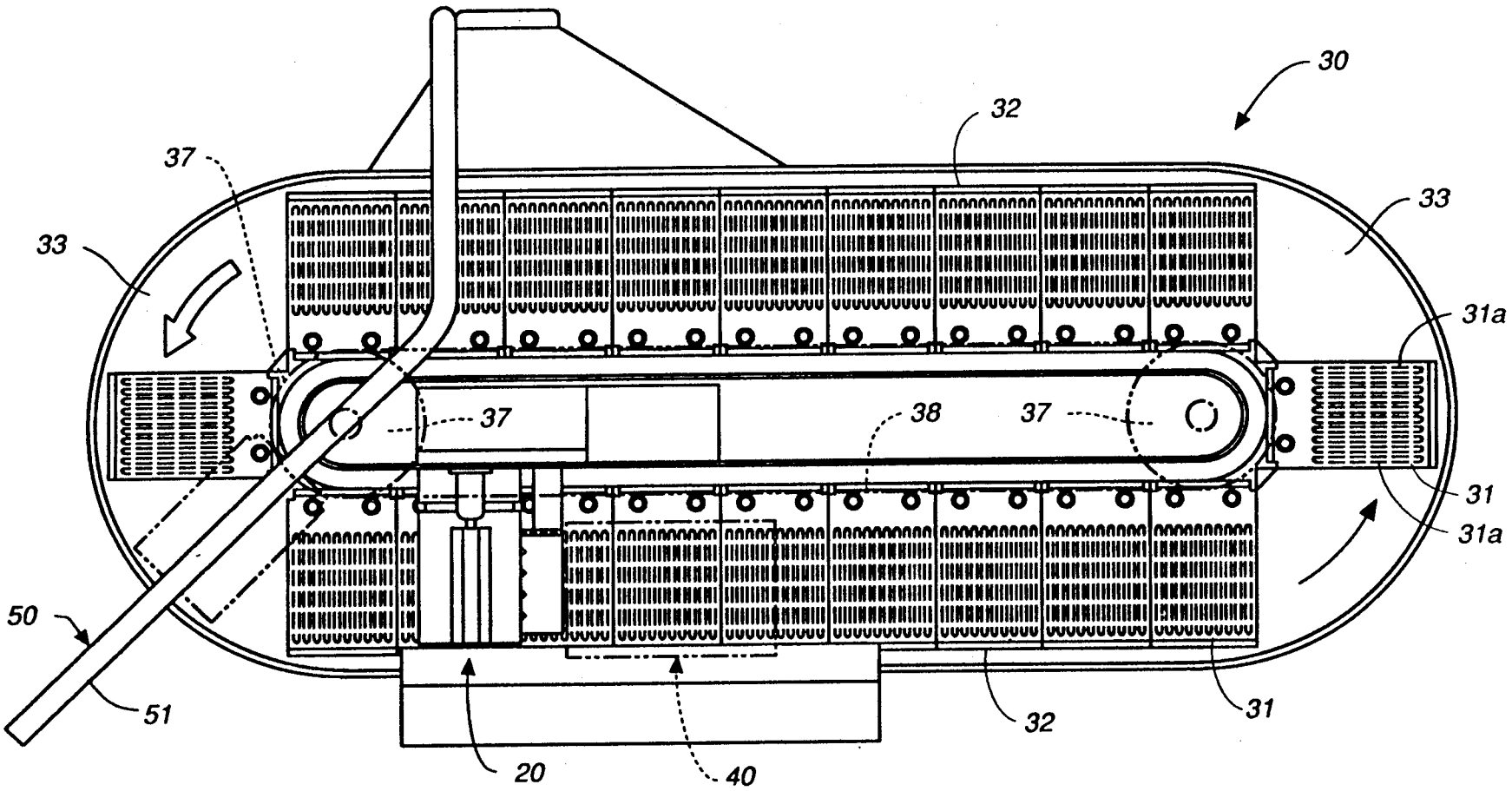
FIG. 1 is a plan view showing a capsule sealing apparatus according to the present invention.
Figure 2:
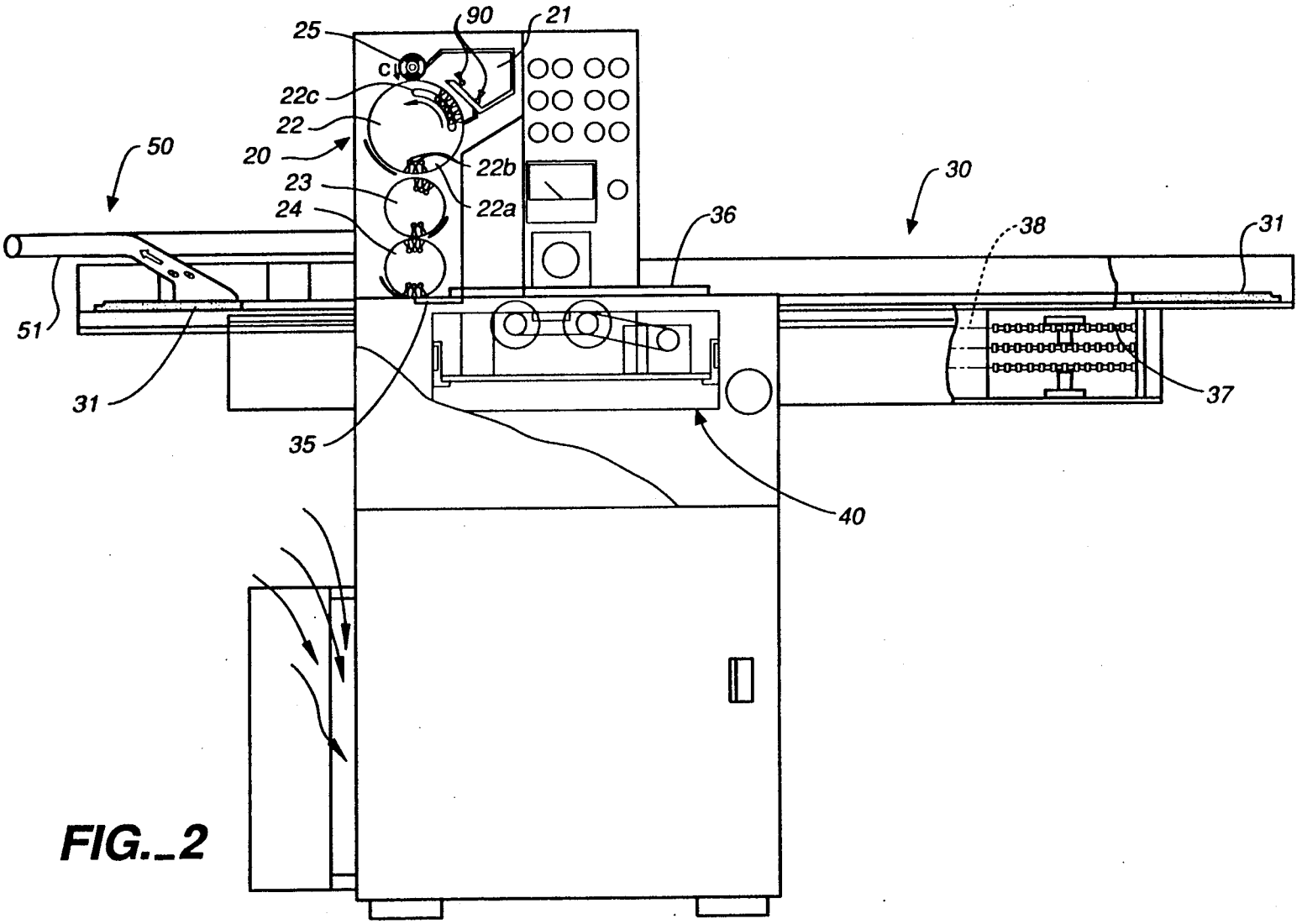
FIG. 2 is a side view showing the apparatus of FIG. 1.

Referring to FIGS. 1 and 2, the capsule sealing apparatus includes a capsule conveyor unit 30 that is provided with a capsule aligning device 20 designed to align capsules in a desired direction, and a capsule sealing device 40 located adjacent to anywhere along the conveying route of the capsules.

The capsule conveyor unit 30 includes a pair of horizontal sprockets 37 and a chain 38 running on the sprockets 37. The chain 38 carries a plurality of flat slats 31, each of which is circulated in a horizontal posture. Each slat 31 is provided with capsule resting slits 31*a* whereby capsules are horizontally secured on the slat 31. Hereinafter, the capsule resting slits will be referred to as "slits". The slats 31 are moved sideways in straight movement areas 32 provided in opposite sides of the chain 38, and turned in semi-circular movement areas 33 provided around each sprocket 37, thereby changing their advancing direction. Unlike the prior art referred to above, the slats 31 are horizontally maintained throughout the travel.

The capsule aligning device 20 is disposed above the point from which the slats 31 start in the straight movement area 32, and horizontally aligns capsules having filled contents sealed by the caps. Then the capsule aligning device 20 transfers the aligned capsules onto each slat 31. The reference numeral 35 denotes a capsule shifter, which will be described below.

A sealing device 40 is disposed downstream in the direction in which the slats 31 are moved. The sealing device 40 coats each charged capsule with a sealer along the seam between the cap and the body so as to seal the capsule. There is provided a capsule positioning device 36 (FIG. 2), which will be described below.

Figure 3:
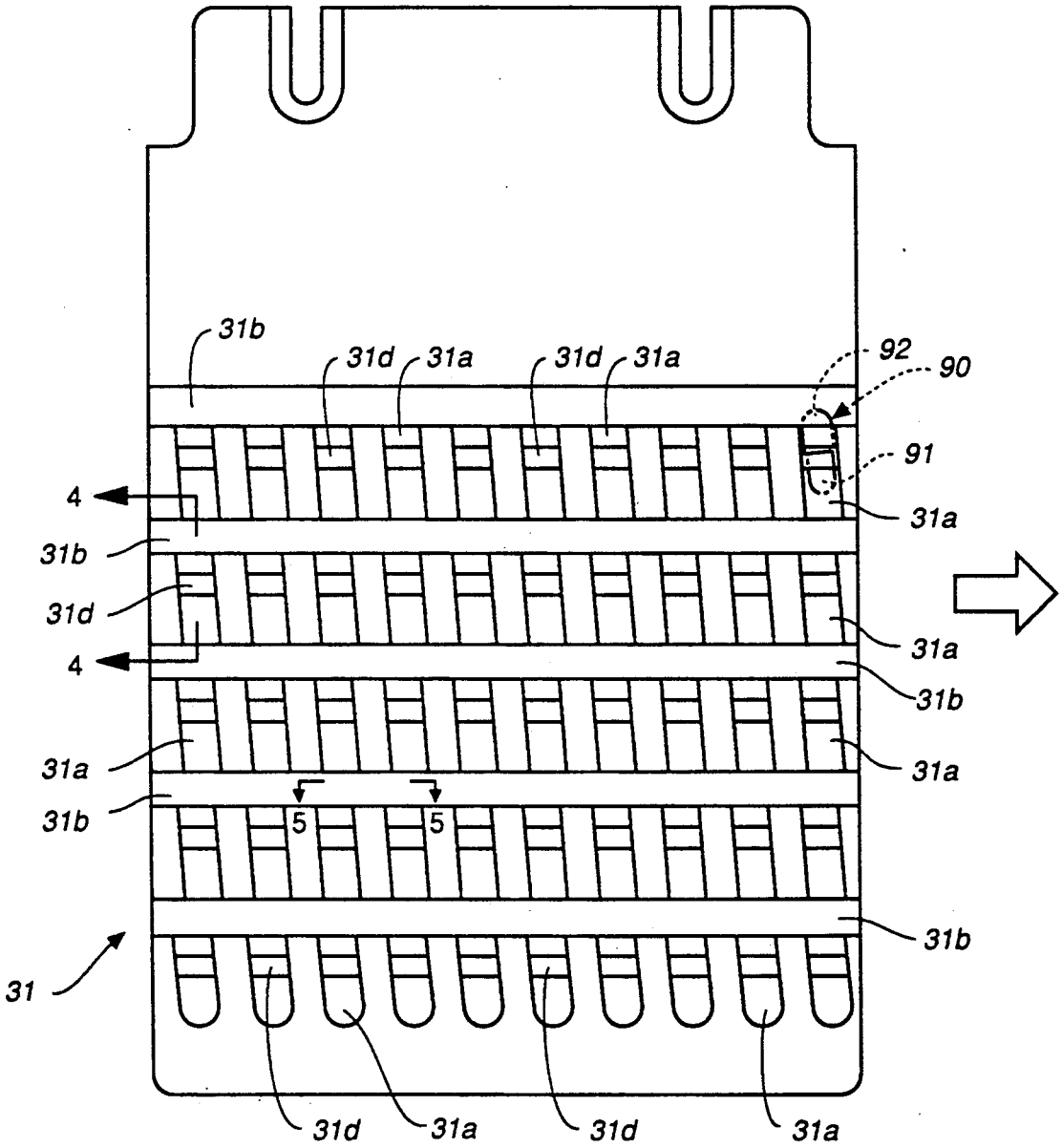
FIG. 3 is a plan view showing the slats shown in FIG. 1.
Figure 4:
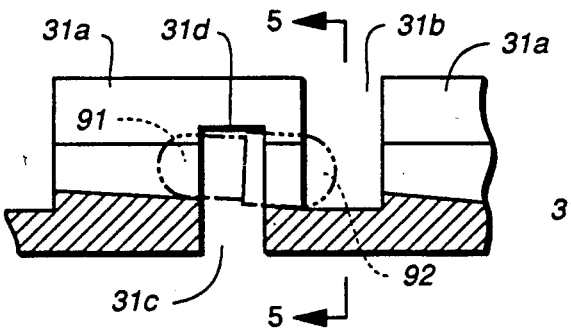
FIG. 4 is a cross-sectional view taken along the line IV—IV in FIG. 3.
Figure 5:
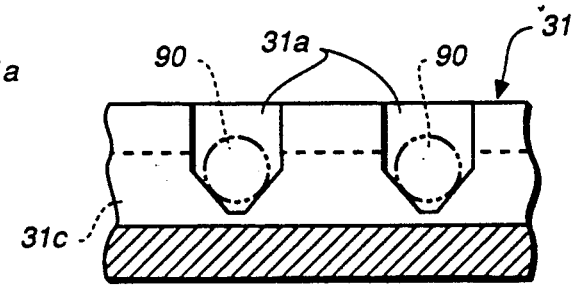
FIG. 5 is a cross-sectional view taken along the line V—V in FIG. 3.

As shown in FIGS. 3 to 5, each slat 31 mounted on the capsule conveyor unit 30 has a plurality of slits 31*a* in which each capsule is secured. The slits 31*a* slant at about 5° in the direction in which the slats 31 as a whole are moved, thereby enabling each capsule to slant at the same angle in the same direction. One row can accommodate a desired number of capsules; in the illustrated embodiment, each row accommodates ten capsules. The number of rows are also optionally determined. The slit 31*a* has a slightly greater width than the maximum diameter of each capsule 90, and is longer than the axial length thereof. Each capsule is open at its top end. The capsule aligning device 20 aligns the capsules 90 such that the capsules are arranged with their caps 92 situated inside of the respective bodies 91.

As shown in FIG. 5, each slit 31*a* has a V-shaped bottom, and when the slats 31 carrying the capsules 90 are in the semi-circular movement area 33 the bottom is slanted inward at about 3° so that when the capsules 90 are placed in the slits 31*a*, the caps 92 are situated lower than the bodies 91.

The reference numeral 31*b* denotes guide grooves for facilitating the conveyance of capsules 90, the guide grooves being formed in the direction in which the slats 31 are moved in the semi-circular movement area 33. The slits 31*a* and the guide groove 31*b* connect with each other.

In FIG. 4 the reference numeral 31*c* denotes grooves in which rollers fit, the grooves being in parallel with the guide grooves 31*b*, and connecting with the slits 31*a* through openings 31*d*. The capsules 90 are placed on the slits 31*a* such that the bodies 91 and the caps 92 meet in the openings 31*d*.

Figure 6:
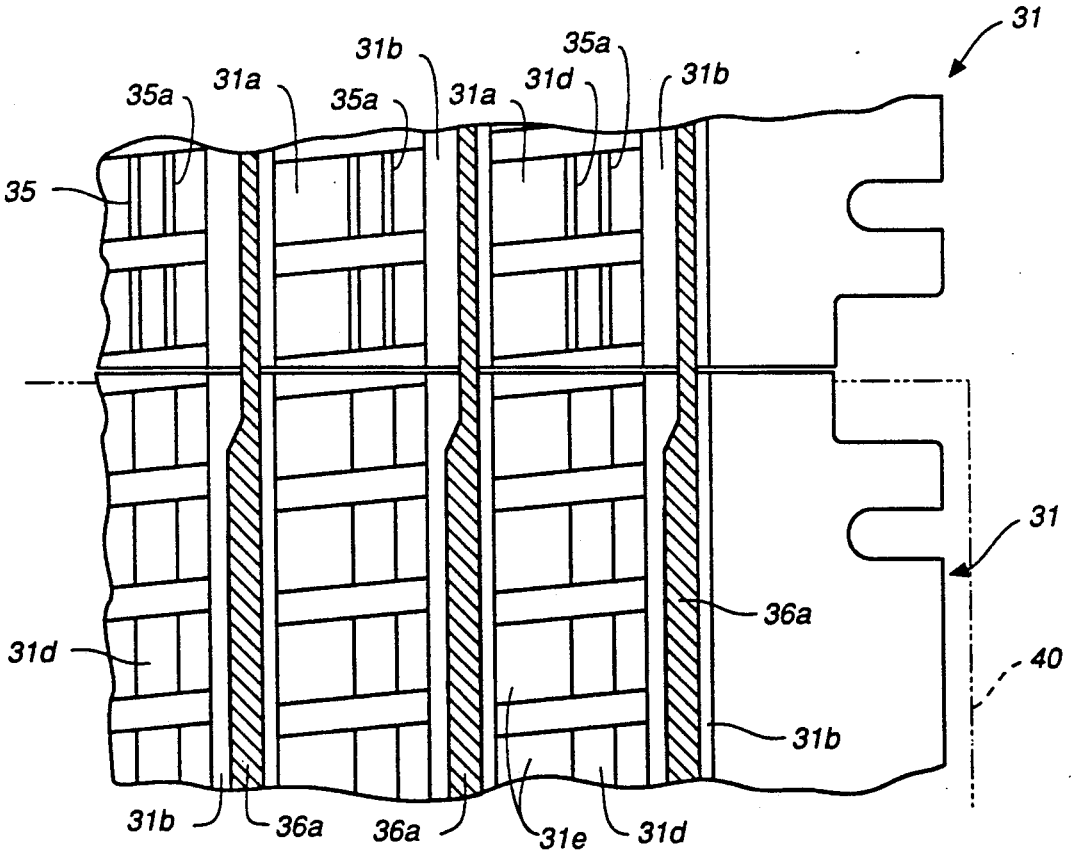
FIG. 6 is a plan view showing a main portion of the capsule conveyor device shown in FIG. 1.
Figure 7:
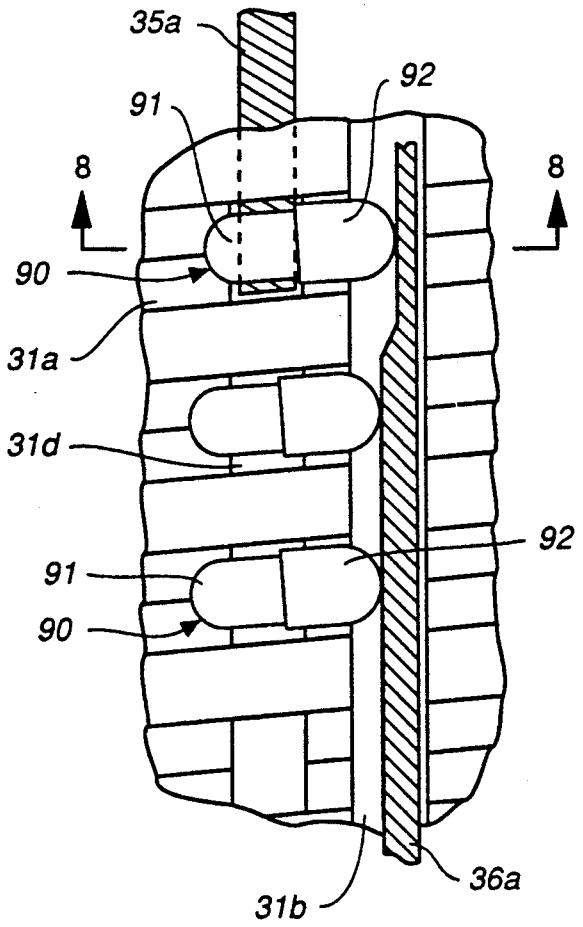
FIG. 7 is a schematic view exemplifying the operation of the capsule conveyor device.
Figure 8:
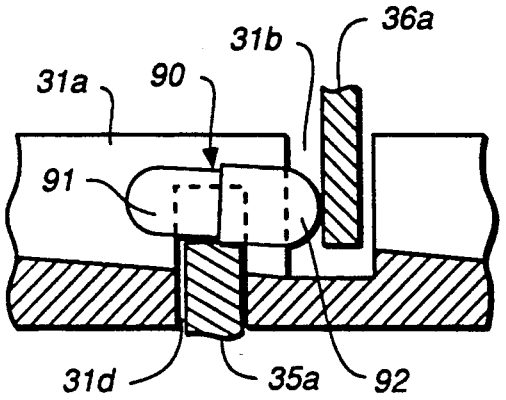
FIG. 8 is a cross-sectional view taken along the line VIII—VIII in FIG. 7.

Referring to FIGS. 6 to 8, the capsule shifter 35 includes five capsule shifting plates 35*a* whose top ends are individually inserted in the grooves 31*c* of the slats 31. As shown in FIG. 8, the capsule 90 placed in each slit 31*a* is raised by the capsule shifting plate 35*a* when the slats 31 pass the capsule shifter 35.

The capsule positioning device 36 includes five cap guide members 36*a*, each of which is situated alongside each cap raised by the capsule shifting plates 35*a* as shown in FIG. 6. Each cap guide member 36*a* is vertically arranged above each guide groove 31*b*, in the direction in which the slats 31 are moved, and its lower end is fitted in the guide groove 31*b*. Each cap 92 of the capsules 90 comes into engagement with the cap guide member 36*a*, and forces the capsule into the slit 31*a*. In order to locate the capsules exactly in the slits 31*a*, the side of each cap guide member 36*a* is slanted toward the slit 31*a* above the capsule sealing device 40. In this way the capsules 90 are placed in the slits 31*a* such that the seams between the caps 92 and the bodies 91 are situated in the openings 31*d*.

Figure 9:
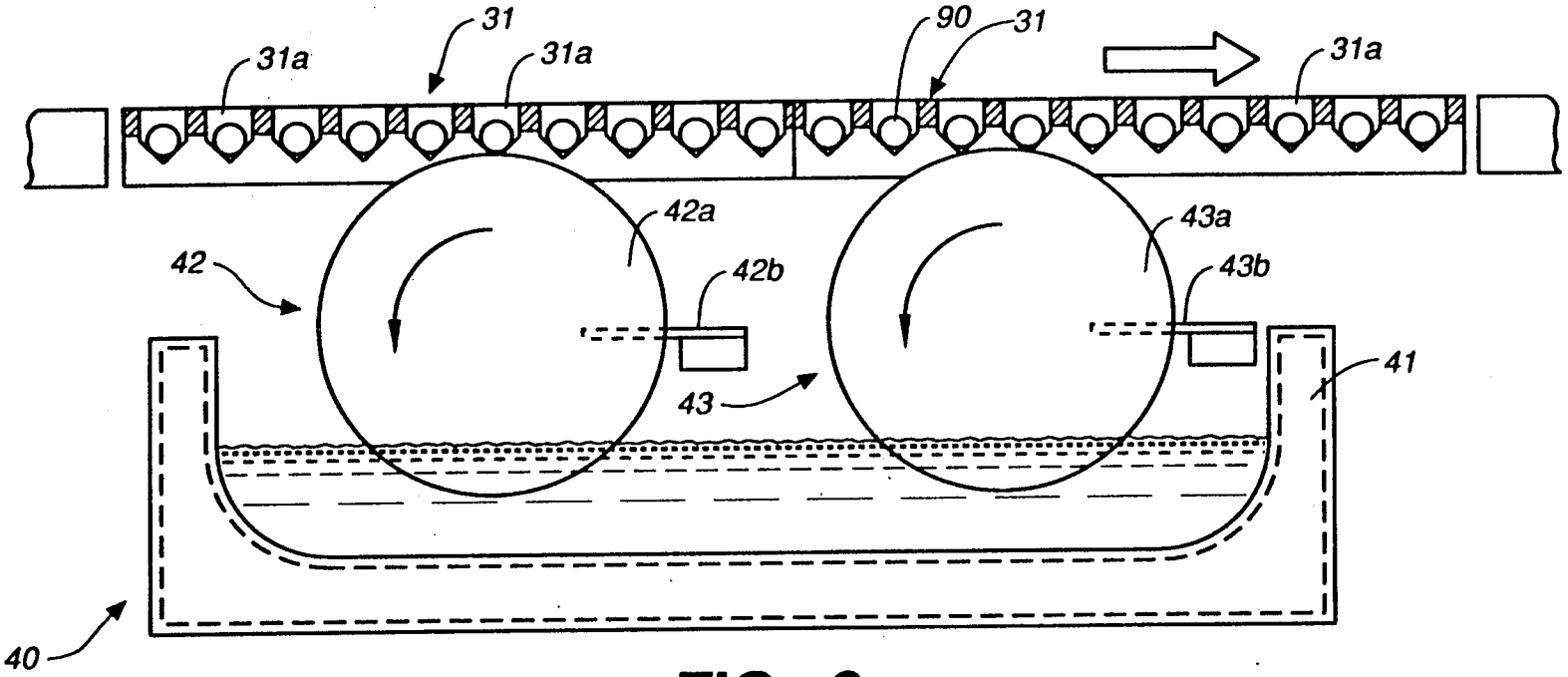
FIG. 9 is a cross-sectional view showing the sealing device incorporated in the apparatus of FIG. 1.
Figure 10:
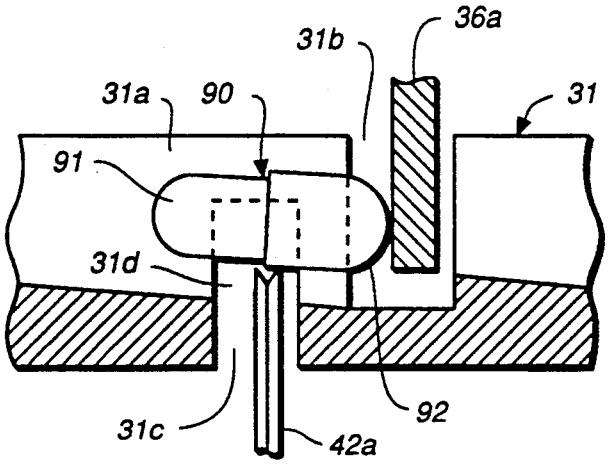
FIGS. 10 and 11 are cross-sectional views showing the relationships between a capsule and a sealer coating means.

Referring to FIG. 9, the sealing device 40 includes a heater built-in tank 41 for storing a sealer, a first coating unit 42 having five coating discs 42*a* and a second coating unit 43 having five finish discs 43*a* arranged in the direction of feed of the slats 31, respectively. The second coating unit 43 is designed to add a coat to the one effected by the first coating unit 42. The first coating unit 42 is positioned in place so that the peripheral edge of each coating disc 42*a* fits in the slits 31*a* of the slats 31 through the opening 31*d* as shown in FIG. 10. The first coating unit 42 is rotated in the opposite direction to that of feed of the slats 31. The peripheral edges of the coating discs 42*a* have a V-shaped groove as shown in FIG. 10, and the lower portion of the first coating unit 42 is submerged in the sealer in the tank 41. The upper portion of the peripheral edge fitted in the slit 31*a* pushes the capsules 90 upward. The coating discs 42*a* pick up the sealer from the tank 41 and coat it along the seams between the caps and bodies of the capsules 90 through the respective coating discs 42*a*. The capsules 90 in the slits 31*a* are rotated by the coating discs 42*a* under the guidance of the cap guide members 36*a* in the slits 31*a*, and during rotation the sealer is coated along the seams between the caps 92 and the bodies 91 of the capsules 90. In this way the seams are sealed.

Figure 11:
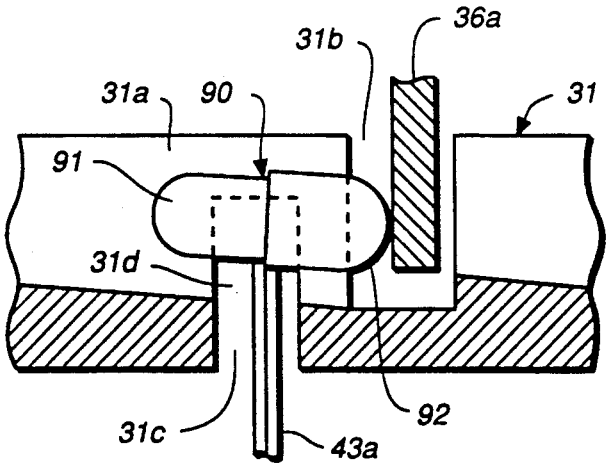

Each finish disc 43*a* of the second coating unit 43 has a stepped peripheral edge as shown in FIG. 11. Likewise, the lower portion of the peripheral edges of each finish disc 43*a* is submerged in the sealer in the tank 41, and the upper portion thereof is fitted into the slits 31*a* through the opening 31*d*. The stepped peripheral edges of the finish discs 43*a* fitted into the slits 31*a* push the capsules 90 upward. The capsules 90 are rotated by the finish discs 43*a* under the guidance of the guide members 36*a*, and coated with the sealer along the seams between the caps 92 and the bodies 91 of the capsules 90.

The tank 41 is provided with scrapers 42*b* and 43*b* designed to remove excess sealer from the coating discs 42*a* and the finish discs 43*a* so as to hold an adequate amount of sealer thereon.

Figure 12:
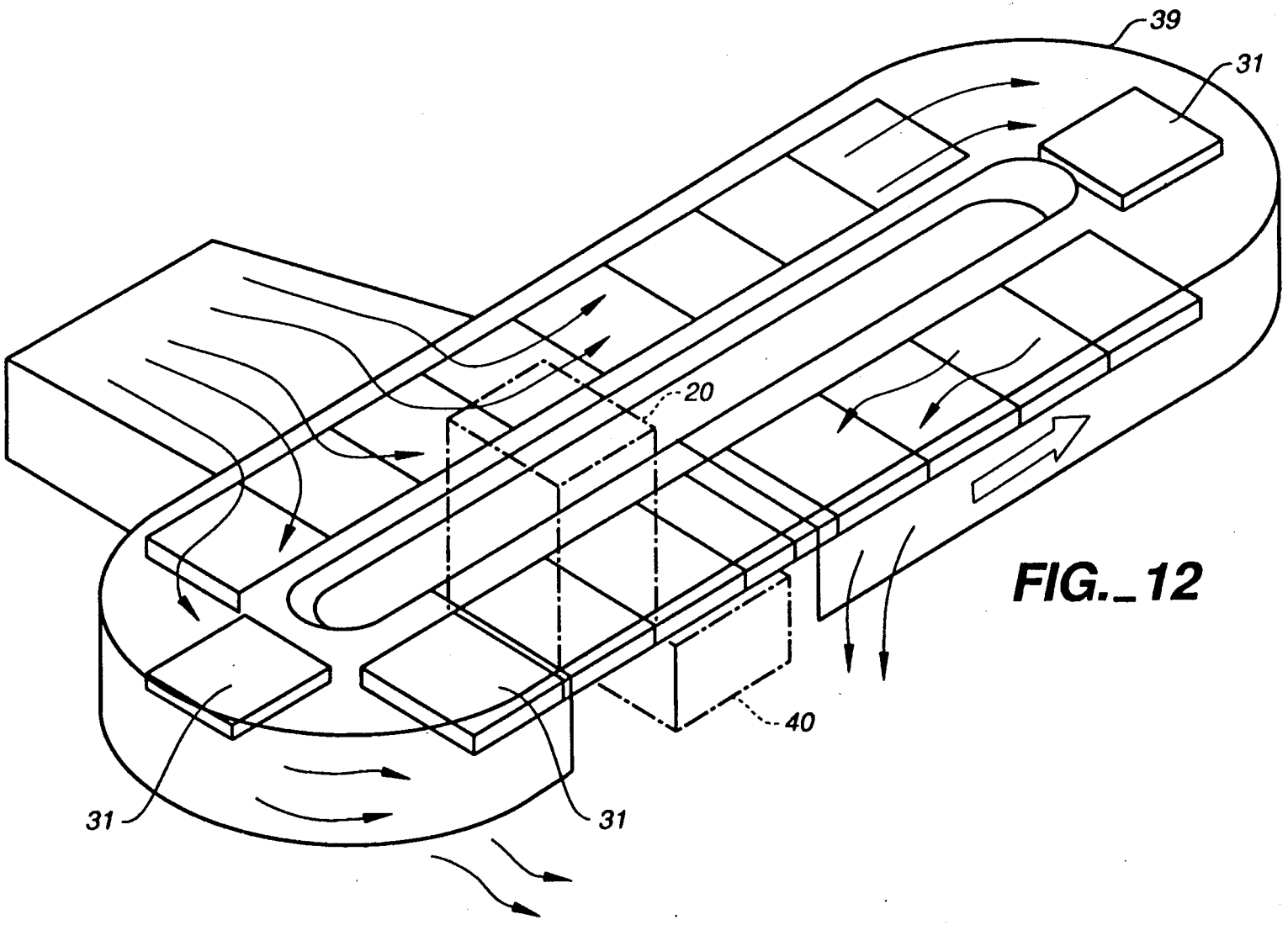
FIG. 12 is a perspective diagrammatic view showing a drying duct covering the capsule sealing apparatus.

Referring to FIG. 12, the capsule conveyor unit 30 is covered with a drying duct 39, except for the portion at which the capsule aligning device 20 and the sealing device 40 are joined. The drying duct 39 receives a supply of air, and the slats 31 travel through the drying duct 39 during which travel the sealer coated on the capsules are dried. In this way the seal between the caps 92 and the bodies 91 of the capsules 90 is effected.

There is provided a capsule collecting device 50 (FIGS. 1 and 2). The collecting device 50 is provided with a sucking pipe or vacuum pipe 51 in which the pressure is reduced so as to suck the capsules 90 into the sucking pipe 51. In this way the capsules 90 are transported to a container (not shown).

The capsule aligning device 20 has a known structure that is disclosed in Japanese Laid-Open Patent Publication (Kokai) No. 60-190964. As shown in FIG. 2, the aligning device 20 comprises a contrarotating drum or roller 24, a regulating roller 23, and a supplying drum 22. The reference numeral 21 denotes a hopper.

The hopper 21 is supplied with capsules 90 that contain a content in the bodies 91 closed with the caps 92.

The supplying drum 22 is rotated in the direction of arrow B, and is provided with pockets 22*a* extending radially of the supplying drum 22 and spaced at intervals on the entire peripheral surface thereof. Each pocket 22*a* has a larger diameter than the outside diameter of the caps 92 so as to accommodate the capsules 90 therein. The hopper 21 supplies the capsules 90 into the pockets 22*a* at a point upstream of the rotation of the drum 22 rather than immediately above the hopper 21.

Each pocket 22*a* has an opening diverging in the direction in which the supplying drum 22 is rotated so as to enable each capsule 90 to enter each pocket 22*a*.

The reference numeral 25 denotes a brush roller having an axis in parallel with that of the supplying drum 22. The brush roller 25 rotates in the direction of arrow C, that is, in the same direction as that of the supplying drum 22. The brush roller 25 returns the capsules 90 left from the pockets 22*a* to the hopper 21.

Each pocket 22*a* has a larger inside diameter than the outside diameter of the cap 92 of each capsule 90, thereby enabling the capsules 90 to enter the pockets 22*a* from either the caps 92 or the bodies 91.

Each pocket 22*a* is connected to an air passage 22*b* at its bottom that extends axially with the supplying drum 22. The air passages 22*b* are connected to a suction port 22*c*. The suction port 22*c* is connected to the air passages 22*b* of the pockets 22*a* that rise up to the uppermost part of the supplying drum 22 so as to reduce the internal pressure in the pockets 22*a*. The suction port 22*c* is connected to a suction means (not shown) to effect reduction in pressure in the air passages 22*b*, and then the pockets 22*a*. In this way each capsule 90 is secured in each pocket 22*a*.

Figure 14:
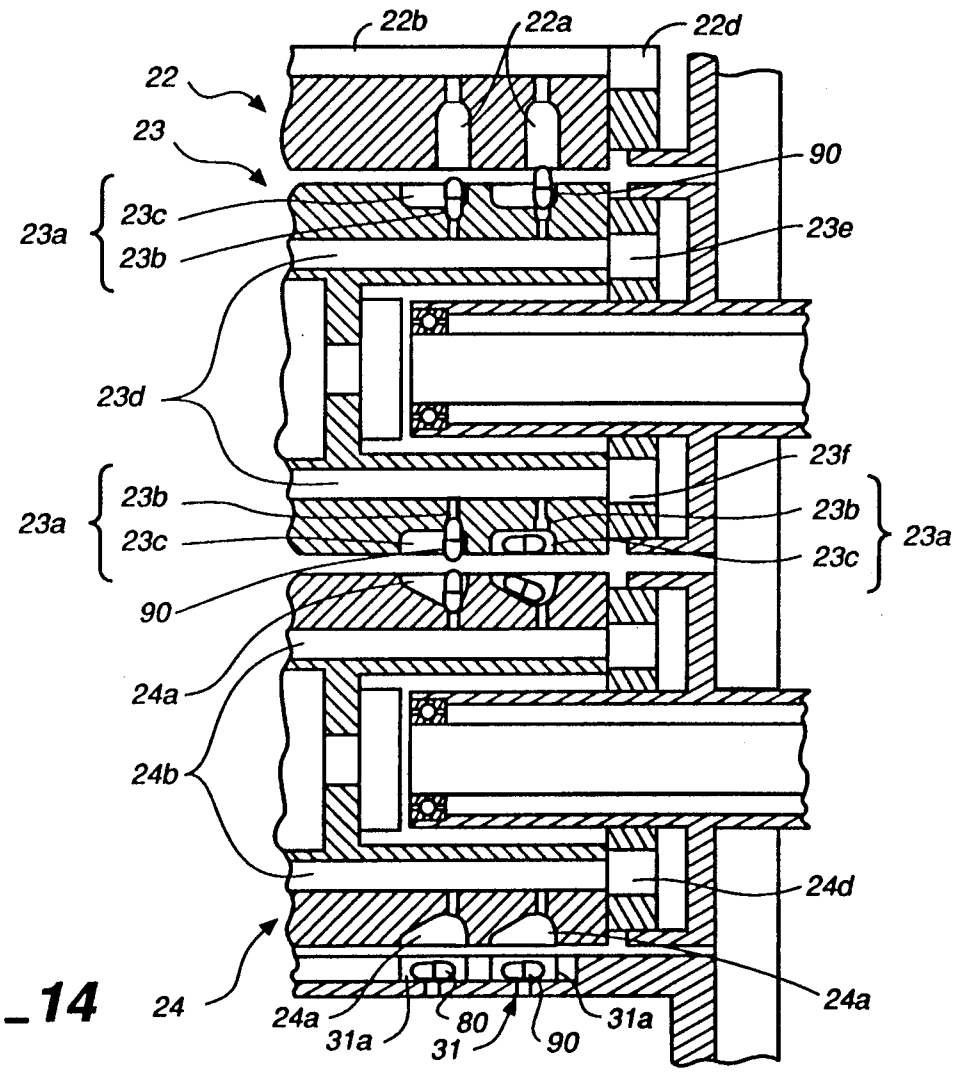
FIG. 14 is a cross-sectional view showing the capsule aligning device of FIG. 13.
Figure 13:
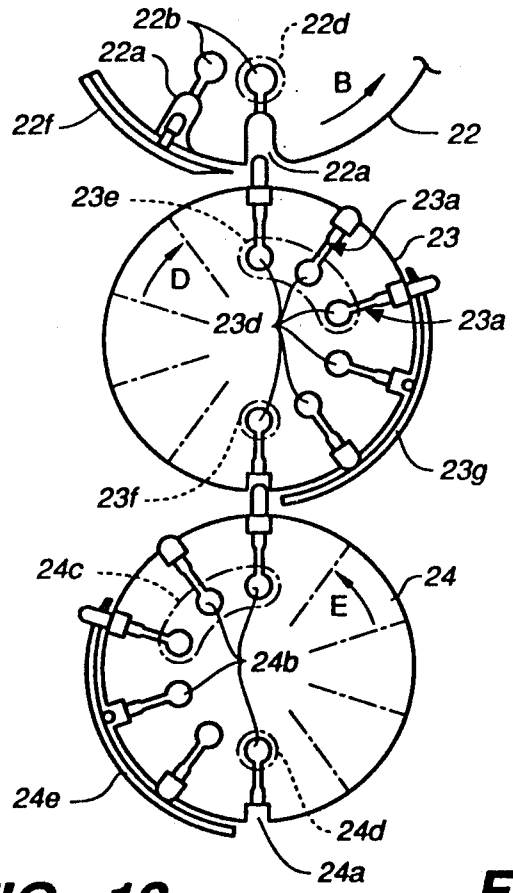
FIG. 13 is a schematic view showing the capsule aligning device.

Referring to FIGS. 13 and 14, the air passage 22*b* connected to the lowermost part of the supplying drum 22 is connected to an air supply passage 22*d* disposed at the end face of the supplying drum 22. Compressed air or the like is supplied to the air supply passage 22*d* through which the compressed air is supplied to the pockets 22*a* located at the lowermost part of the supplying drum 22 so that the capsules 90 contained therein are discharged downward.

The reference numeral 22*f* denotes a plate for preventing the capsules 90 from falling from the pockets 22*a* opposite the plate 22*f*. The plate 22*f* is located adjacent to the lowermost part of the supplying drum 22 and at a point upstream of the rotation thereof.

The regulating roller 23 is positioned below the supplying drum 22, and is rotated in an opposite direction (the direction of arrow D) to that thereof. The regulating roller 23 is provided with pockets 23*a* extending axially therewith and spaced at intervals on the entire peripheral surface of the roller 23.

Each pocket 23*a* has a body supporting portion 23*b* radially extending for supporting the bodies of capsules, and a capsule bed portion 23*c* for accommodating lying capsules 90. The inside diameter of the body supporting portion 23*b* is larger than the outside diameter of the bodies 91 of capsules 90 but smaller than the diameter of the caps 92. The regulating roller 23 is designed to select capsules 90 by allowing capsules 90 to enter the body supporting portion 23*b* if they are inserted from their bodies 91 through the capsule bed portion 23*c* but by not allowing the capsules 90 to enter the body supporting portion 23*b* if they are inserted from their caps 92. The caps 92 of capsules 90 are accommodated in their capsule bed portion 23*c* when their bodies 91 are accommodated in the body supporting portions 23*b*. In this way the capsules 90 as a whole are accommodated in the pockets 23*a*. As a result, the top portions of the capsules 90 are prevented from projecting their caps 92 out of the regulating roller 23. In contrast, if the caps 92 of capsules are accommodated in the pockets 23*c* and the caps 92 are opposed to the body supporting portions 23*b*, the bodies 91 of these capsules 90 are projected outside the regulating roller 23.

The capsule bed portion 23*c* extends axially with the regulating roller 23 so that the capsules 90 are completely accommodated. The body supporting portion 23*b* of each pocket 23*a* is connected at its bottom to an air passage 23*d* extending axially of the regulating roller 23. The air passages 23*d* are connected to a suction port 23*e*. The suction port 23*e* is connected to a sucking means (not shown) that reduces the internal pressure in the pockets 23*a* through the air passage 23*d*.

The regulating roller 23 is provided with an air supply port 23*f* that is connected to the air passages 23*d*. Compressed air is supplied to the pockets 23*a* through the air passages 23*d* from the air supply port 23*f*. The capsules 90 contained in the pockets 23*a* are discharged downward under the pressure of the compressed air.

Figure 15:
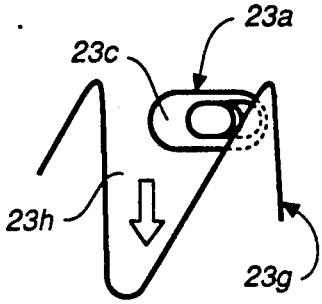
FIG. 15 is a schematic fragmentary view showing a protective plate of the capsule regulating roller.

The reference numeral 23*g* denotes a guard plate disposed along a lower part of the regulating roller 23. As shown in FIG. 15, the guard plate 23*g* is provided with notches 23*h* that are open toward the upstream direction, the notches 23*h* being open in the upstream direction. The notches 23*h* are located opposite to the pockets 23*a*, and one side wall is slanted so that the bodies 91 of the capsules 90 that project out of the regulating roller 23 are caused to lie down and accommodated in the capsule bed portion 23*c* in accordance with the rotation of the regulating roller 23. In this case, the capsules 90 are accommodated in the capsule bed portions 23*c* with their caps 92 in opposition to the body supporting portions 23*b*.

The top end portion of the guard plate 23*g* faces the suction port 23*e*, and the falling capsules 90 are sucked under reduced pressure provided through the suction port 23*e*. In this way they are safely accommodated.

The contrarotating roller 24 disposed below the regulating roller 23 has the same configuration as that of the regulating roller 23, and as shown in FIG. 13, rotates opposite to the direction E of the regulating roller 23 but at the same velocity. The contrarotating roller 24 is provided with capsule accommodating pockets 24*a* on the entire peripheral surface thereof. Each capsule accommodating pocket 24*a* has a size sufficient to accommodate the capsules 90, and has openings open toward the pockets 23*a* so as to enable the openings of both pockets 23*a* and 24*a* to meet.

The bottom portion of the capsule accommodating pockets 24*a* are slanted so as to increase the depth thereof toward the body supporting portions 23*b*. The bottoms of the capsule accommodating pockets 24*a* are connected to an air passage 24*b* extending axially with the contrarotating roller 24. The air passage 24*b* is connected to the deepened portion of the capsule accommodating pockets 24*a*. The reference numeral 24*c* denotes a suction port that is connected to those air passages 24*b* that are situated in an area from the uppermost portion of the contrarotating roller 24 to the downstream portion thereof.

At the uppermost portion of the contrarotating roller 24 where the suction port 24*c* is connected to the air passages 24*b* of the pockets 24*a*, the pockets 24*a* face those pockets 23*a* of the regulating roller 23 that are situated at the lowermost portion thereof. In this way the internal pressure in the pockets 24*a* is reduced, and air is supplied into the pockets 23*a* of the regulating roller 23 so that the capsules 90 in the pockets 23*a* are conveyed into the pockets 24*a* of the contrarotating roller 24. At this stage, while the bodies of the capsules 90 are accommodated in the body supporting portions 23*b* of the pockets 23*a*, the capsules 90 are inserted into the pockets 24*a* with their caps 92 foremost, wherein the caps 92 are accommodated in the deep portions of the pockets 24*a* with parts of their bodies 91 projecting out of the contrarotating roller 24. Other capsules 90 accommodated in the capsule bed portions 23*c* of the regulating roller 23 in their lying posture are inserted into the pockets 23*a* with their caps 92 foremost by the flow of air blown from the body supporting portions 23*b*. In this way the caps 92 of the capsules 90 are accommodated in the deep portions of the pockets 23*a*, wherein the capsules 90 are placed in the pockets 24*a* in their slanting postures.

Figure 16:
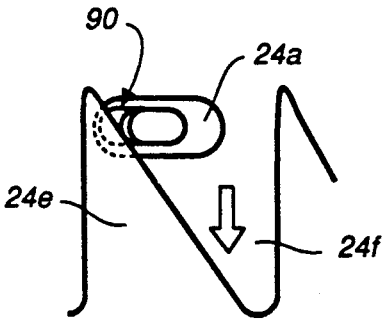
FIG. 16 is a schematic fragmentary view showing a guard plate of the contrarotating roller.

The reference numeral 24*e* denotes a guide plate disposed so as to protect the pockets 24*a* passing the lowermost part of the contrarotating roller 24. The guide plate 24*e* is provided with notches 24*f* as shown in FIG. 16, which have a slanting side wall designed to cause the capsule 90 to fall down and accommodate them in the pockets 24*a* when parts of the capsules 90 project out of the contrarotating roller 24. In this way the guide plate 24*e* ensures that once the pockets 24*a* have passed it the capsules 90 are aligned, and accommodated in the deep portions of the pockets 24*a*.

The contrarotating roller 24 is provided with an air supply port 24*d* at its lower part, which supplies air to the pockets 24*a* through the air passages 24*b* situated in the lowermost part of the contrarotating roller 24. Compressed air is supplied to the air supply port 24*d*, and is supplied into the pockets 24*a* so that the capsules 90 contained in the pockets 24*a* are discharged downwards.

The capsules 90 discharged from the pockets 24*a* are transferred into the slits 31*a* of the slats 31 of the capsule conveyor unit 30.

In operation, the capsules 90 are aligned in the slits 31*a* of the slats 31. Then the slats 31 are conveyed to the sealing device 40, in the course of which the capsules 90 are raised by the capsule shifting plates 35*a* so as to shift them toward their caps 92. The caps 92 of the capsules 90 are brought into contact with the cap guide members 36*a*, thereby locating each capsule 90 in place in the slits 31*a* so that the seam between the cap 92 and the body 91 of each capsule is located at the sealing position, that is, in the opening 31*d* in the slit 31*a*.

At this stage, the slats 31 are conveyed above the sealing device 40. The coating discs 42*a* are forced into the openings 31*d* and come into abutment with the seams between the caps 92 and the bodies 91 of the capsules 90 so that sealer is coated along the seams while the capsules 90 are in rotation. Then, the finish discs 43*a* are equally forced into the openings 31*d* and applied to the same seams of each capsule 90. In this way the sealer is coated on the seams of the capsules 90 to a desired thickness.

The capsules 90 whose seams are sealed with the sealer are conveyed to the drying duct 39 and travel within it. In this way the sealer becomes dry. Finally, the capsules 90 are sucked into a container (not shown) by means of the vacuum pipe 51 of the capsule collecting device 50.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A capsule sealing apparatus, comprising:

a capsule conveyor device comprising slats each having at least one surface which is maintained substantially horizontal at all times, the slats including capsule resting slits, each slit including an opening at its bottom;

a tank for storing a sealer disposed below a circulating route of the capsule conveyor device; and a rotary coating means for picking up the sealer from the tank and coating same along the seam between a cap and a body of each capsule, said rotary coating means being insertable through the openings of the capsule resting slits and coming into contact with the seams of the capsules so as to impart frictional rotating drive to the capsules.

2. A capsule sealing apparatus according to claim 1, wherein the capsule resting slits slant to the extent that the capsules are accommodated therein at a slant of about 5° with respect to the horizontal plane in the direction in which the slats are circulated.

3. A capsule sealing apparatus according to claim 2, wherein the capsule resting slits have side walls slanting so that the capsules accommodated therein are at a slant in the direction in which the slats are circulated.

4. A capsule sealing apparatus according to claim 1, wherein the capsule resting slits have V-shaped side walls so that the capsules accommodated therein are kept in linear contact therewith.

5. A capsule sealing apparatus according to claim 1, wherein the capsule resting slits slant so that the capsules accommodated therein slant with their one end downward.

6. A capsule sealing apparatus according to claim 1, wherein the capsule conveyor device comprises means for shifting the capsules accommodated in the respective capsule resting slits in a desired direction by direct engagement therewith.

7. A capsule sealing apparatus according to claim 1, wherein the capsule conveyor device comprises means for positioning the capsules in place in the capsule resting slits by direct engagement therewith after they are shifted by the shifting means.

8. A capsule sealing apparatus according to claim 1, wherein the rotary coating means is disposed downstream of a capsule aligning device in a direction in which the slats are moveable and comprises a second coating means for coating the sealer picked up from the tank on the seams coated by the first coating means, the second coating means being insertable through the openings of the capsule resting slits and comes into contact with the seams of the capsules so as to cause the capsules to rotate.

9. A capsule sealing apparatus according to claim 1, wherein the rotary coating means comprises a V-shaped peripheral edge along its entire circumference and the second coating means comprises a stepped peripheral edge along its entire circumference so that the peripheral edges come into full contact with the seams between the caps and the bodies of capsules.

10. A capsule sealing apparatus according to claim 1, wherein the capsule conveyor device is covered by a drying duct, except for a portion thereof at which the sealing means is located.

* * * * *